US010476219B1

(12) United States Patent
Hazel

(10) Patent No.: US 10,476,219 B1
(45) Date of Patent: Nov. 12, 2019

(54) POWER ADAPTOR

(71) Applicant: William Hazel, Brookside Village, TX (US)

(72) Inventor: William Hazel, Brookside Village, TX (US)

( * ) Notice: Subject to any disclaimer, the term of this patent is extended or adjusted under 35 U.S.C. 154(b) by 0 days.

(21) Appl. No.: 15/967,699

(22) Filed: May 1, 2018

(51) Int. Cl.
*G05F 1/16* (2006.01)
*H01R 31/06* (2006.01)
*H01R 25/00* (2006.01)

(52) U.S. Cl.
CPC ..... *H01R 31/06* (2013.01); *H01R 25/003* (2013.01)

(58) Field of Classification Search
CPC ..... H02M 5/12
USPC ..... 323/258
See application file for complete search history.

(56) References Cited

U.S. PATENT DOCUMENTS 4,543,624 A 9/1985 Rumble
6,290,543 B1 * 9/2001 Plummer, Jr. ..... H01R 27/00 439/639
7,515,444 B2 4/2009 Chen
8,480,416 B2 7/2013 Farris-Gilbert
D702,636 S 4/2014 Benedict
9,511,676 B2 12/2016 Loftus
9,531,287 B1 12/2016 Johnson

FOREIGN PATENT DOCUMENTS

WO 2012168469 12/2012

* cited by examiner

*Primary Examiner* — Phuong Chi T Nguyen

(57) ABSTRACT

The power adapter comprises an adapter plug, a first interconnect, a first outlet, a second interconnect, and one or more second outlets. The adapter plug and the first outlet are high amperage connectors such as NEMA TT-30 connectors. The one or more second outlets are standard lower amperage outlets such as NEMA 5-15R outlets. The power adapter allows a standard low amperage device to be plugged in without drawing current through the RV electrical system. The plug is first plugged into the RV outlet provided at a wired campsite then the RV power plug is plugged into the first outlet of the power adapter. The standard low amperage device may then be plugged into the one or more second outlets.

11 Claims, 5 Drawing Sheets

POWER ADAPTOR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of recreational vehicle accessories, more specifically, a power adapter.

SUMMARY OF INVENTION

The power adapter comprises an adapter plug, a first interconnect, a first outlet, a second interconnect, and one or more second outlets. The adapter plug and the first outlet are high amperage connectors such as NEMA TT-30 connectors. The one or more second outlets are standard lower amperage outlets such as NEMA 5-15R outlets. The power adapter allows a standard low amperage device to be plugged in without drawing current through the RV electrical system. The plug is first plugged into the RV outlet provided at a wired campsite then the RV power plug is plugged into the first outlet of the power adapter. The standard low amperage device may then be plugged into the one or more second outlets.

An object of the invention is to provide a power adapter to connect an RV power plug with an RV outlet at a wired campsite Another object of the invention is to provide one or more standard low amperage outlets at the power adapter.

These together with additional objects, features and advantages of the power adapter will be readily apparent to those of ordinary skill in the art upon reading the following detailed description of the presently preferred, but nonetheless illustrative, embodiments when taken in conjunction with the accompanying drawings.

In this respect, before explaining the current embodiments of the power adapter in detail, it is to be understood that the power adapter is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the power adapter.

It is therefore important that the claims be regarded as including such equivalent construction insofar as they do not depart from the spirit and scope of the power adapter. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
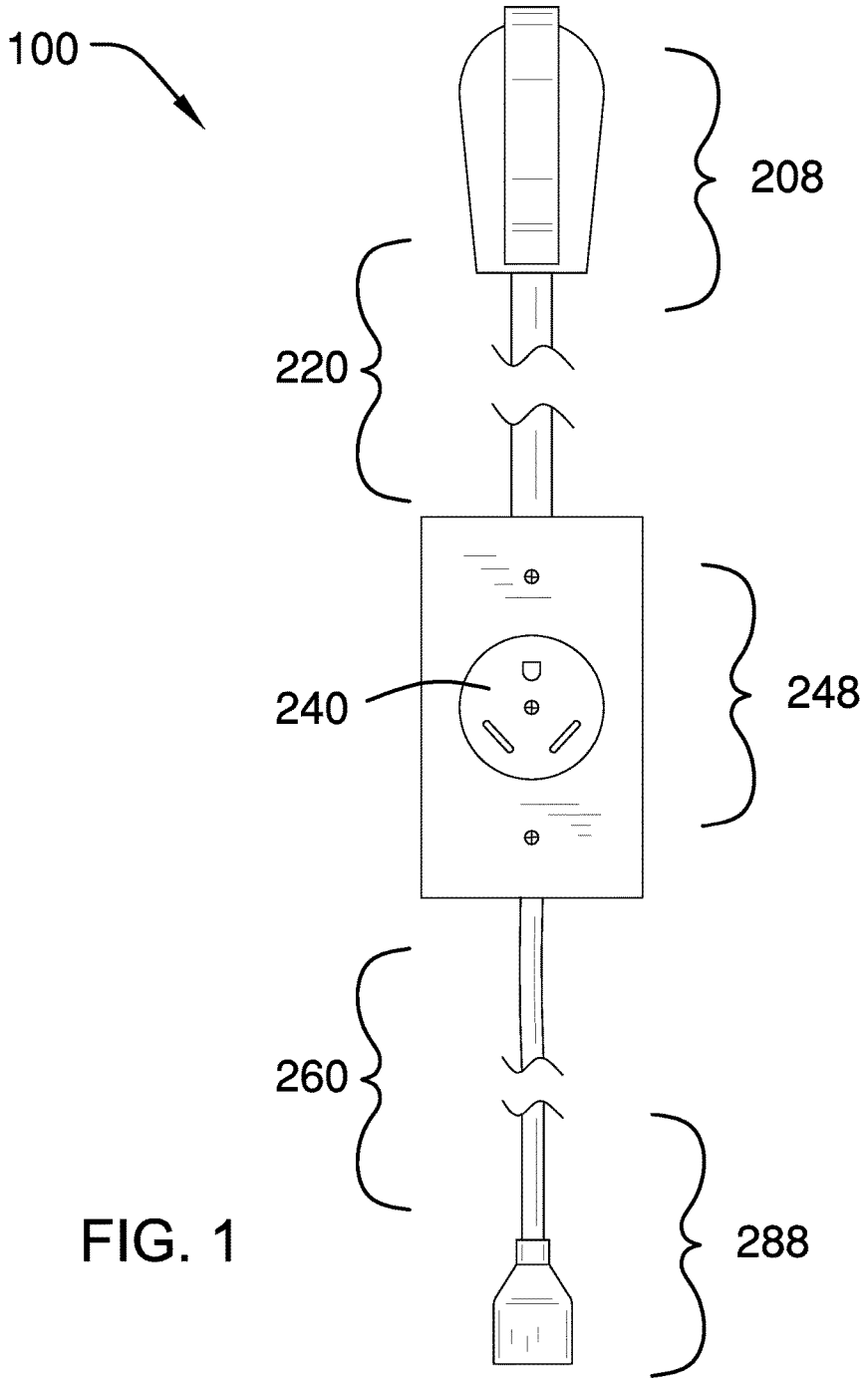
FIG. 1 is a front view of an embodiment of the disclosure.
Figure 2:
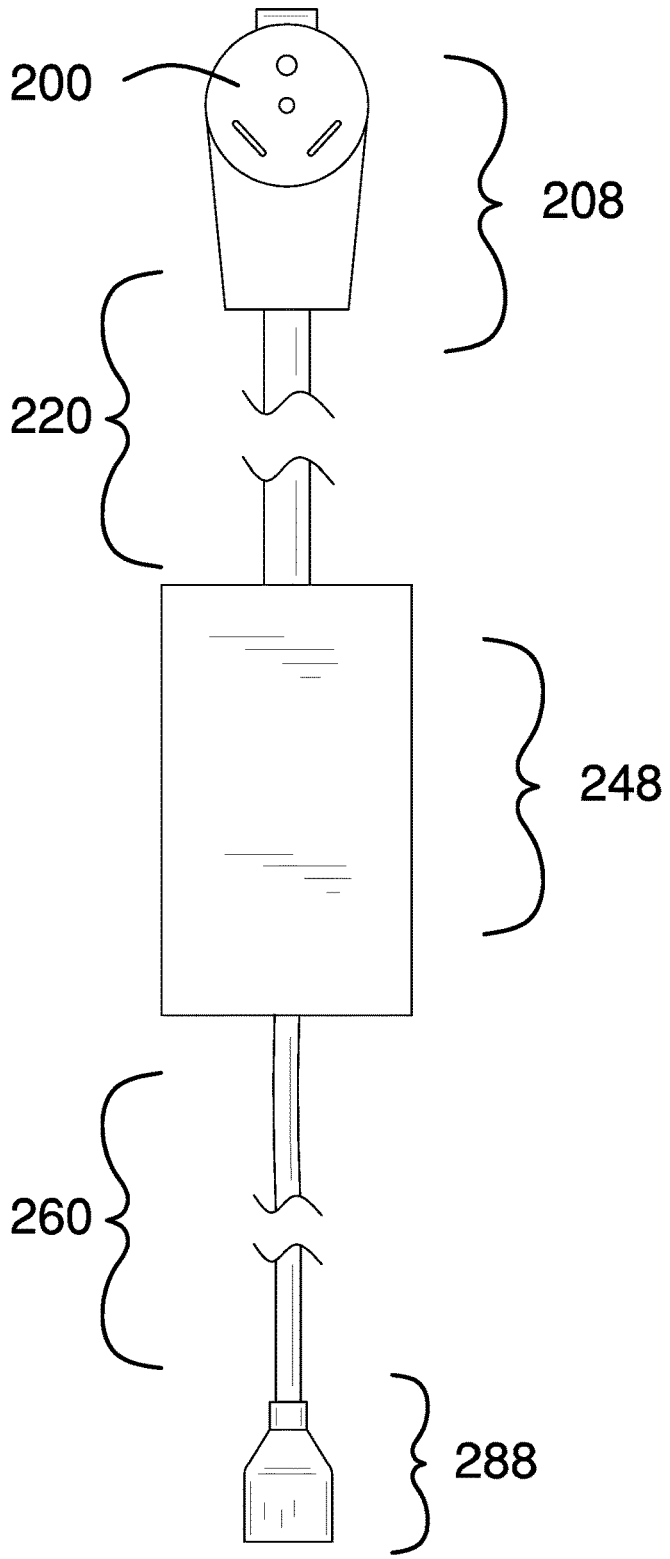
FIG. 2 is a rear view of an embodiment of the disclosure.
Figure 3:
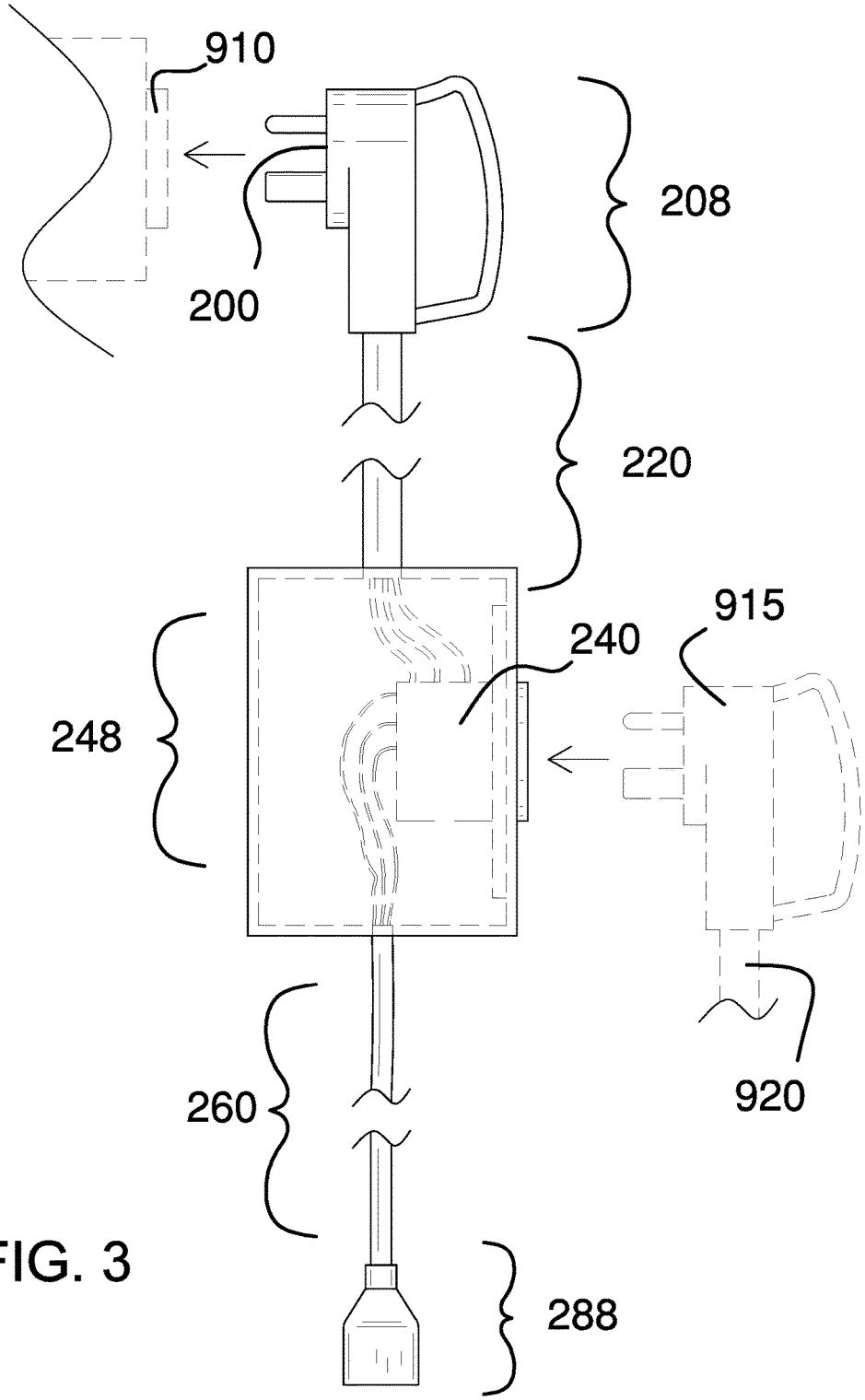
FIG. 3 is a side view of an embodiment of the disclosure.
Figure 4:
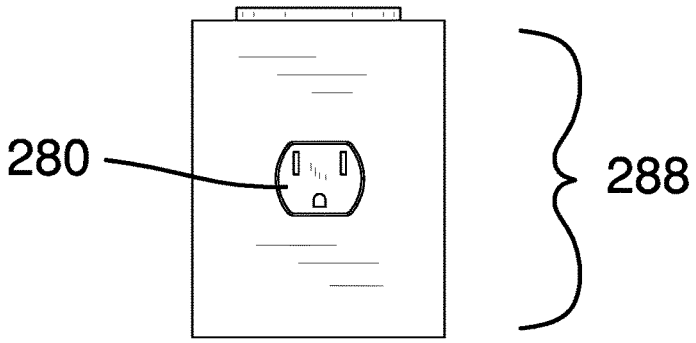
FIG. 4 is a bottom view of an embodiment of the disclosure across 4-4 as shown in FIG. 2.
Figure 5:
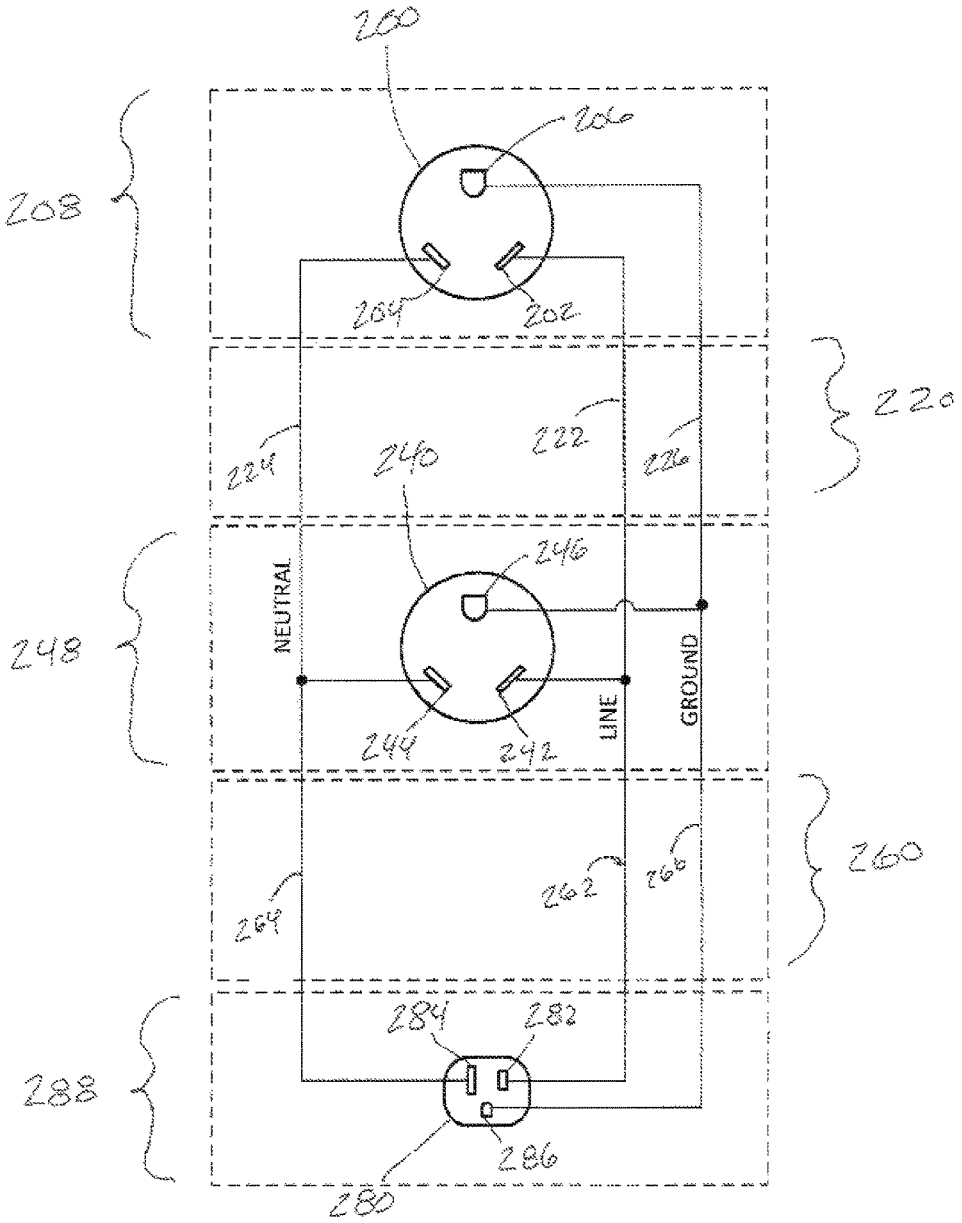
FIG. 5 is a schematic diagram of an embodiment of the disclosure.

Detailed reference will now be made to a first potential embodiment of the disclosure, which is illustrated in FIGS. 1 through 5.

The power adapter 100 (hereinafter invention) comprises an adapter plug 200, a first interconnect 220, a first outlet 240, a second interconnect 260, and one or more second outlets 280. The invention 100 is an adapter that allows a recreational vehicle (not illustrated in the figures) to be powered from an RV outlet 910 of 30 amps or more while also providing a lower amperage outlet for use by a device (not illustrated in the figures) without having to power the device through an electrical system of the recreational vehicle. As a non-limiting example, the device may be a heater for use under the recreational vehicle.

The adapter plug 200 may be a male electrical connector designed to pass 30 to 50 amps of electricity at a potential of 125 VAC. As non-limiting examples, the adapter plug 200 may be a NEMA TT-30 connector for 30 amp service provided at a campsite or a NEMA 14-50 connector for 50 amp service provided at the campsite. The adapter plug 200 may mate with the RV outlet 910. The adapter plug 200 may comprise at least an adapter plug line contact 202, an adapter plug neutral contact 204, and an adapter plug ground contact 206. The adapter plug 200 may be electrically and mechanically coupled to the first interconnect 220. The adapter plug 200 may be enclosed in a plug housing 208. As a non-limiting example, the plug housing 208 may be a rubberized enclosure.

The first interconnect 220 may couple the adapter plug 200 to the first outlet 240. The first interconnect 220 may comprise at least a first interconnect line conductor 222, a first interconnect neutral conductor 224, and a first interconnect ground conductor 226. The first interconnect line conductor 222 may be coupled to the adapter plug line contact 202 on the adapter plug 200. The first interconnect neutral conductor 224 may be coupled to the adapter plug neutral contact 204 on the adapter plug 200. The first interconnect ground conductor 226 may be coupled to the adapter plug ground contact 206 on the adapter plug 200.

The first outlet 240 may be a female electrical connector designed to pass 30 to 50 amps of the electricity at a potential of 125 VAC. As non-limiting examples, the first outlet 240 may be a NEMA TT-30 connector for 30 amp service provided at the campsite or a NEMA 14-50 connector for 50 amp service provided at the campsite. The adapter plug 200 and the first outlet 240 may physically and electrically match. Specifically, if the adapter plug 200 is a 30A NEMA TT-30 plug, then the first outlet 240 is a 30A NEMA TT-30 outlet. This assures that an RV power plug 915 on an RV power cable 920 that couples with the RV outlet 910 may couple with the first outlet 240 when the adapter plug 200 is coupled with the RV outlet 910. The first outlet 240 may mate with the RV power plug 915. The first outlet 240 may comprise at least a first outlet line contact 242, a first outlet neutral contact 244, and a first outlet ground contact 246. The first outlet line contact 242 may be coupled to the first interconnect line conductor 222. The first outlet neutral contact 244 may be coupled to the first interconnect neutral conductor 224. The first outlet ground contact 246 may be coupled to the first interconnect ground conductor 226. The first outlet 240 may be electrically and mechanically coupled to the second interconnect 260. The first outlet 240 may be enclosed in a first outlet housing 248. As a non-limiting example, the first outlet housing 248 may be a metal or plastic enclosure.

The second interconnect 260 may couple the first outlet 240 to the one or more second outlets 280. The second interconnect 260 may comprise at least a second interconnect line conductor 262 and a second interconnect neutral conductor 264. The second interconnect line conductor 262 may be coupled to the first outlet line contact 242 on the first outlet 240. The second interconnect neutral conductor 264 may be coupled to the first outlet neutral contact 244 on the first outlet 240. In some embodiments, the second interconnect 260 may comprise a second interconnect ground conductor 266 and the second interconnect ground conductor 266 may be coupled to the first outlet ground contact 246 on the first outlet 240.

The one or more second outlets 280 may be female electrical connectors designed to pass 15 to 20 amps of the electricity at a potential of 125 VAC. Unlike the adapter plug 200 and the first outlet 240 which are designed to carry higher currents in the 30 amp to 50 amp range and which therefore comprise unique physical arrangements and sizes of contacts, the one or more second outlets 280 are intended to be used with standard electrical equipment operating at lower current levels of under 20 amps. As non-limiting examples, the one or more second outlets 280 may be a NEMA 5-15 connector or a NEMA 5-20 connector. The one or more second outlets 280 may mate with a device power plug (not illustrated in the figures). Each of the one or more second outlets 280 may comprise at least a second outlet line contact 282 and a second outlet neutral contact 284. The second outlet line contact 282 may be coupled to the second interconnect line conductor 262. The second outlet neutral contact 284 may be coupled to the second interconnect neutral conductor 264. In some embodiments, each of the one or more second outlets 280 may comprise a second outlet ground contact 286 and the second outlet ground contact 286 may be coupled to the second interconnect ground conductor 266. The one or more second outlets 280 may be enclosed in a second outlet housing 288. As a non-limiting example, the second outlet housing 288 may be a rubberized enclosure.

In use, the recreational vehicle is parked at the campsite and the adapter plug 200 is mated with the RV outlet 910 available at the campsite. The RV power plug 915 located at the end of the RV power cable 920 is mated with the first outlet 240, completing the electrical connection of the recreational vehicle. The device may then be powered by plugging the device power plug into the one or more second outlets 280. As a non-limiting example, the device may be a heater for use under the recreational vehicle and the invention 100 may allow operation of the device without routing the electricity through the electrical system of the recreational vehicle.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used herein, an "adapter" refers to a device that is designed to convert a first interface to a second interface. The conversion may require changes in mechanical shape or size, electrical signaling, power levels, pressures, or other physical attributes.

As used in this disclosure, a "cable" is a collection of insulated wires covered by a protective casing that is used for transmitting electricity or telecommunication signals.

As used herein, the words "couple", "couples", "coupled" or "coupling", refer to connecting, either directly or indirectly, and does not necessarily imply a mechanical connection.

As used herein, "mate" refers to coupling at a predefined interface.

As used herein, "NEMA" or the "National Electrical Manufacturers Association" refers to a trade association of electrical equipment manufacturers in the United States. NEMA publishes standards including major standards for electrical enclosures, motors and magnet wire, AC plugs and receptacles. The NEMA connectors are universal in North America and also used by some other countries.

As used herein, "NEMA TT-30" refers to a NEMA standard for 120V 30A recreational vehicle power connectors. (TT stands for Travel Trailer.) The TT-30 receptacle is commonly available in nearly all RV parks in the United States and Canada, and many RVs manufactured since the 1970s use a TT-30 plug to connect to power feeds.

As used in this disclosure, an "outlet" is a device placed in the electrical wiring system of a building where electrical current can be taken to run electrical devices. In this disclosure, an outlet is a socket adapted to receive a plug. In some embodiments, an outlet may find use in a vehicle or on equipment. As non-limiting examples, outlets may be used on recreational vehicles and on generators.

As used in this disclosure, a "plug" is an electrical termination that electrically connects a first electrical circuit to a second electrical circuit or a source of electricity. As used in this disclosure, a plug will have at least two metal pins.

As used herein, a "recreational vehicle" or "RV" is a vehicle that is designed for recreational purposes, such as for camping.

As used in this disclosure, "VAC" is an abbreviation for alternating current voltage.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A power adapter comprising:

an adapter plug, a first interconnect, a first outlet, a second interconnect, and one or more second outlets;

wherein the power adapter is an adapter that allows a recreational vehicle to be powered from an RV outlet of 30 amps or more while also providing a lower amperage outlet for use by a device without having to power the device through an electrical system of the recreational vehicle;

wherein the adapter plug mates with the RV outlet;

wherein the adapter plug comprises at least an adapter plug line contact, an adapter plug neutral contact, and an adapter plug ground contact;

wherein the adapter plug is electrically and mechanically coupled to the first interconnect;

wherein the adapter plug is enclosed in a plug housing;

wherein the first outlet mates with an RV power plug;

wherein the first outlet comprises at least a first outlet line contact, a first outlet neutral contact, and a first outlet ground contact; wherein the first outlet line contact is coupled to the first interconnect line conductor;

wherein the first outlet neutral contact is coupled to the first interconnect neutral conductor;

wherein the first outlet ground contact is coupled to the first interconnect ground conductor;

wherein the first outlet is electrically and mechanically coupled to the second interconnect;

wherein the first outlet is enclosed in a first outlet housing; wherein the second interconnect couples the first outlet to the one or more second outlets;

wherein the second interconnect comprises at least a second interconnect line conductor and a second interconnect neutral conductor;

wherein the second interconnect line conductor is coupled to the first outlet line contact on the first outlet; wherein the second interconnect neutral conductor is coupled to the first outlet neutral contact on the first outlet; wherein the second interconnect comprises a second interconnect ground conductor;

wherein the second interconnect ground conductor is coupled to the first outlet ground contact on the first outlet; wherein each of the one or more second outlets comprise at least a second outlet line contact and a second outlet neutral contact;

wherein the second outlet line contact is coupled to the second interconnect line conductor;

wherein the second outlet neutral contact is coupled to the second interconnect neutral conductor;

wherein the adapter plug is a male electrical connector designed to pass 30 to 50 amps of electricity at a potential of 125 alternating current voltage VAC;

wherein the adapter plug is a National Electrical Manufacturers Association NEMA Travel Trailer TT-30 connector for 30 amp service provided at a campsite or a National Electrical Manufacturers Association NEMA 14-50 connector for 50 amp service provided at the campsite.

2. The power adapter according to claim 1 wherein the plug housing is a rubberized enclosure.

3. The power adapter according to claim 1 wherein the first interconnect couples the adapter plug to the first outlet;

wherein the first interconnect comprises at least a first interconnect line conductor, a first interconnect neutral conductor, and a first interconnect ground conductor;

wherein the first interconnect line conductor is coupled to the adapter plug line contact on the adapter plug;

wherein the first interconnect neutral conductor is coupled to the adapter plug neutral contact on the adapter plug;

wherein the first interconnect ground conductor is coupled to the adapter plug ground contact on the adapter plug.

4. The power adapter according to claim 3 wherein the first outlet is a female electrical connector designed to pass 30 to 50 amps of the electricity at a potential of 125 alternating current voltage.

5. The power adapter according to claim 4 wherein the first outlet is a National Electrical Manufacturers Association NEMA Travel Trailer-30 connector for 30 amp service provided at the campsite or a National Electrical Manufacturers Association 14-50 connector for 50 amp service provided at the campsite.

6. The power adapter according to claim 4 wherein the adapter plug and the first outlet physically and electrically match.

7. The power adapter according to claim 6 wherein the first outlet housing is a metal or plastic enclosure.

8. The power adapter according to claim 7 wherein the one or more second outlets are female electrical connectors designed to pass 15 to 20 amps of the electricity at a potential of 125 alternating current voltage;

wherein the one or more second outlets are National Electrical Manufacturers Association 5-15 connectors or National Electrical Manufacturers Association 5-20 connectors.

9. The power adapter according to claim 8 wherein the one or more second outlets mate with a device power plug.

10. The power adapter according to claim 9 wherein each of the one or more second outlets comprise a second outlet ground contact and the second outlet ground contact is coupled to the second interconnect ground conductor;

wherein the one or more second outlets are enclosed in a second outlet housing.

11. The power adapter according to claim 10 wherein the second outlet housing is a rubberized enclosure.

* * * * *